United States Patent [19]

Lang

[11] Patent Number: 4,725,731

[45] Date of Patent: Feb. 16, 1988

[54] PHOTORECEPTOR DELETION CONTROL BY UTILIZATION OF CORONA WIND

[75] Inventor: Joseph H. Lang, Webster, N.Y.

[73] Assignee: Xerox Corporation, Stamford, Conn.

[21] Appl. No.: 881,142

[22] Filed: Jul. 2, 1986

[51] Int. Cl.[4] ..... H01T 19/04

[52] U.S. Cl. ..... 250/326; 250/324

[58] Field of Search ..... 250/324, 325, 326; 355/3 CH; 269/229, 230

[56] References Cited

U.S. PATENT DOCUMENTS

| | | | |
|---|---|---|---|
| 3,358,289 | 12/1967 | Po Lee | 250/325 |
| 3,396,308 | 8/1968 | Whitmore | 250/326 |
| 3,619,719 | 11/1971 | Waller et al. | 361/230 |
| 3,643,128 | 2/1972 | Testone | 250/326 |
| 3,675,096 | 7/1972 | Kiess | 250/326 |
| 4,591,713 | 5/1986 | Gundlach et al. | 250/324 |

*Primary Examiner*—Bruce C. Anderson

*Attorney, Agent, or Firm*—Mark Costello

[57] ABSTRACT

A scorotron assembly for charging a photoconductive surface to a uniform potential comprises a pair of pin array coronodes having an array of projections extending towards a surface to be charged, a conductive screen, and a support arrangement supporting the screen between the pin array coronodes and a surface to be charged. To prevent the adsorption and subsequent desorption of corona effluents by conductive members of the scorotron, believed to cause photoreceptor deletion copy imperfections, the scorotron is provided with openings in said support member to allow the flow of air therethrough into the area between the screen, and the support members. The directional flow of ions flowing from the pin array coronodes towards the conductive screen generates a strong, substantially parallel air flow flowing therewith, and exhausting through the screen, aiding in the removal of corona effluents from the area.

6 Claims, 2 Drawing Figures

Figure 1:
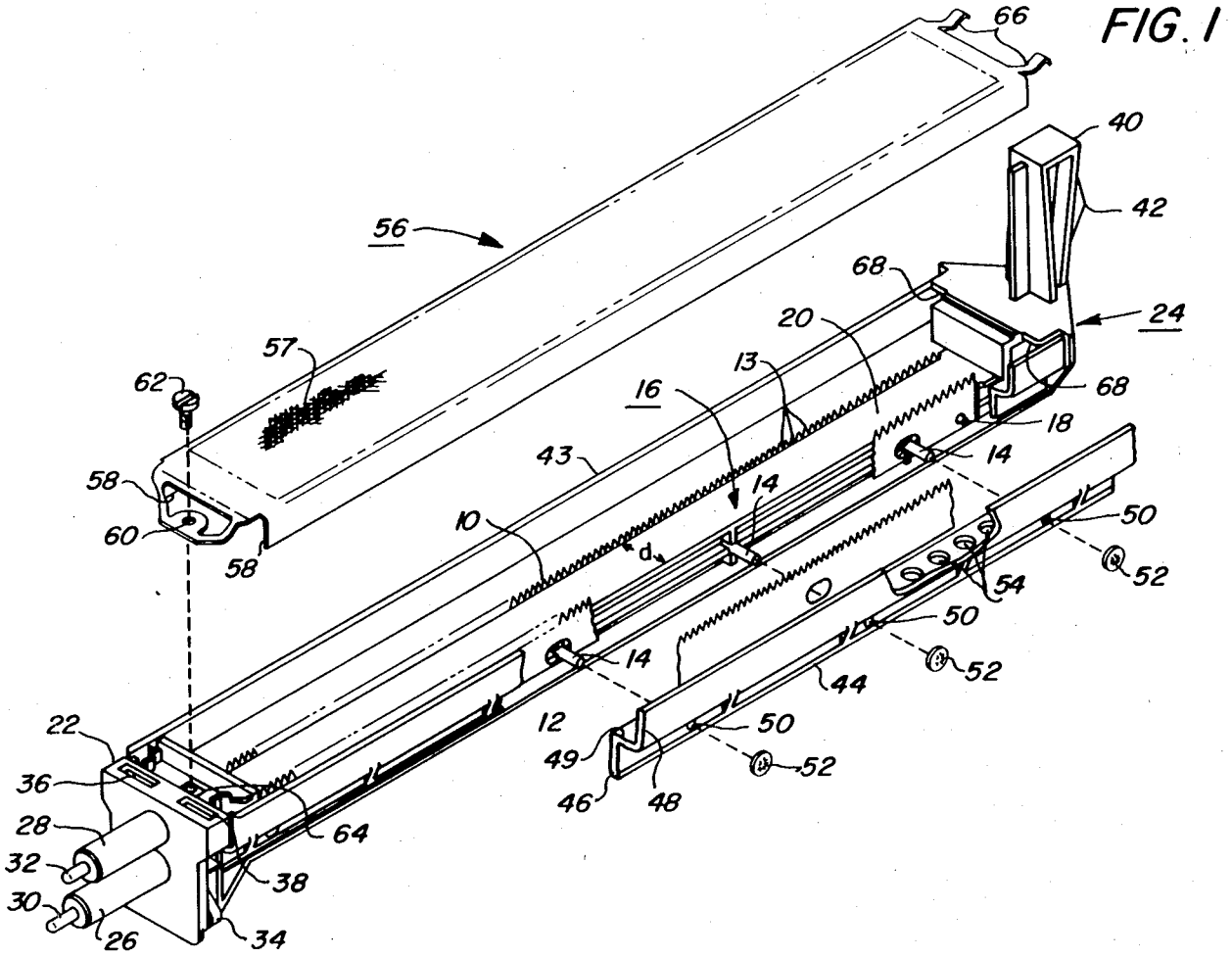

66
40
42
24
68
18
14
68
20
13
16
14
43
10
56
57
58
62
58
60
50
52
54
50
52
44
50
52
48
46
49
12
14
64
38
34
22
36
28
32
30
26

PHOTORECEPTOR DELETION CONTROL BY UTILIZATION OF CORONA WIND

This invention relates generally to corona devices for charging insulating surfaces and more particularly to an improved pin array scorotron for charging a photoconductive surface in a reproduction machine which provides for removal of corona byproducts in the area adjacent the photoreceptor by utilization of corona wind.

CROSS REFERENCE

Cross-reference is hereby made to copending and earlier filed U.S. patent application Ser. No. 750,845, now issued as U.S. Pat. No. 4,646,196 to Reale and to the co-pending application entitled "Pin Corotron and Scorotron Assembly" application Ser. No. 881,144, filed July 2, 1986, both assigned to the same assignee as the present application.

INCORPORATION BY REFERENCE

U.S. Pats. Nos. 4,592,713 to Gundlach et al and 4,646,196 to Reale are incorporated herein by reference for the purpose of background information.

BACKGROUND OF THE INVENTION

Corona devices are known which are used in reproduction machines employing a photoconductive element to produce copies of documents to be reproduced. During reproduction processes such as xerography, it is necessary to apply a uniform level of charge to a photoconductive surface such as photoreceptor member, which charge will subsequently be selectively dissipated by exposure to light as part of the operation of the reproduction machine. In xerographic processes, the non-discharged portions retain their charge in the form of a latent image on the photoconductive surface, and when subsequently brought into contact with toner material, will retain toner on the surface of the photoreceptor in the areas where the charge has not been dissipated. In a commonly used charging device, a high voltage generally in the range of 5000 to 8000 volts is applied to a wire extending between insulating end blocks mounted within a channel or shield and held closely adjacent a surface to be charged to create a corona spray which imparts electrostatic charge to the surface to be charged. In another similar device, (referred to hereinafter as a scorotron) providing more uniform charging and preventing over charging, two or more wires are provided with a screen or control grid held at a uniform lower potential than the wires disposed between the wires and the photoreceptor. This arrangement suppresses the electric field between the photoconductive surface and the wires, and reduces ion current flow to the photoreceptor. In yet another variation of a charging device commonly used with photoreceptor elements requiring negative charging, a dicorotron comprising a wire coated with a relatively thick dielectric material such as glass in an arrangement otherwise similar to a corotron may be used. Negative precharging of certain photoreceptor types prior to charging to a uniform positive potential is often desirable as well.

Difficulties are observed when using corona charging devices that produce a negative corona. While not clearly understood, it is believed that various nitrogen oxide species are produced by the corona, and that these nitrogen oxide species are adsorbed by solid surfaces, particularly the conductive members which form part of the corona producing device. After exposure to the nitrogen oxide species, when the machine is turned off for extended periods of time, it is believed that the nitrogen oxide species are gradually desorbed either in the same form as originally noted, or in other forms. Whatever the nature of the process, when operation of the machine is resumed, a copy quality defect is observed in the copies produced where a line image deletion or lower density image is formed across the width of the photoreceptor at the portion of the surface thereof which was at rest adjacent to the corona producing device during the period of idleness. While the exact mechanism is not clearly understood, it is believed that the desorbed species interact with the photoreceptor material layers increasing the lateral conductivity thereof, so that the photoreceptor cannot retain a charge in image fashion to be subsequently developed with toner. This causes narrow line images to blur, wash out or not be developed as a toner image. This defect has been observed in a variety of photoreceptor and negative charging arrangements as well as negative pre-charge arrangements.

Prolonged exposure of the photoreceptor to the desorbed species appears to have the effect of increasing the defect. The problem is noted after relatively short operational periods, and subsequent periods of idleness. Cleaning the photoreceptor after initial exposure to the desorbed species with a cleaning solution such as alcohol as a healing effect as the initial reactions appear to be only at the photoreceptor surface. However, after prolonged exposure, the reaction tends to penetrate into the photoreceptor and cannot be cleaned away. The defect is reversible to some extent by a rest period, but the period required is on the order of several days. Frequent cleaning and extended periods of nonuse are undesirable remedies.

A variety of solutions have been proposed for the prevention of the problem of what is commonly referred to as photoreceptor deletion, primarily directed to coating or plating conductive members with non-reactive materials. In one solution, the shield portions of corotrons were plated with relatively non-reactive materials such as gold. It is believed that gold provides a relatively inert surface which does not adsorb the nitrogen oxides species. While gold has a positive effect in reducing photoreceptor deletion, the expense is undesirably high. Coatings, such as lead, reactive metal based paints, or alkali metal silicate coatings, which are intended to absorb and/or neutralize the nitrogen oxide species have also been used with some success, but still add substantially to the cost of the corona generating members. Additionally, while somewhat successfully preventing photoreceptor deletion, the alkali metal silicate coatings produce byproducts of the reaction in the form of a powder. When used in conjunction with scorotron charging, the powder, presumably an alkali metal nitrate, collects on the control grid, effects the operational characteristics of the device, alters the electrical characteristics of the screen, and causes non-uniformities in the electric field between the photoreceptor and the corona charging wires. Coating members to avoid adsorption appears to be effective, but adds significant cost to the manufacture of corona devices.

It is known that circulation of air through the area adjacent the corona charging member and the photoreceptor appears to have a preventative effect on the problems associated with nitrogen oxide species. Removal of corona by-products by circulation of air appears to prevent, to some degree, the adsorption of the nitrogenous species by the conductive elements of the corona producing device, and accordingly, their subsequent release. Thus for example, in U.S. Defensive Publication No. T940,022 by Rodda, an electrostatographic copying system is shown provided with a blower and filter system, which through circulation of air, has the advantage of exhausting and filtering corona byproduct species to prevent photoreceptor image deletions.

It is also known in corona devices that the corona emissions produced thereby are associated with corona winds comprised of ionized air molecules which acquire significant velocities such that their momentum carries the ions towards the surface to be charged. If the flow thereof is substantially unidirectional, these winds create a vacuum effect behind the charge member which draws air from that area towards the charge receiving surface. U.S. Pat. No. 3,324,291 to Hudson suggests a corotron arrangement producing a corona wind substantial enough to be useful in cleaning the surfaces of a charging device of particulate matter such as toner particles.

In a variation of known charging devices, an electrically conductive electrode strip having projections, teeth, scalloped portions, or pins formed integrally with and extendng from an edge of the sheet metal strip may be substituted for the wires of a conventional charging device with certain other structural modifications necessary for functional implementation as shown, for example, in U.S. Pat. No. 3,691,373 to Compton or U.S. Pat. No. 4,592,713 to Gundlach et al. In this arrangement, a corona is generated at the pin tips to impart the requisite charge onto the photoconductive surface. This coronode arrangement (hereinafter referred to as a pin array coronode) has significant structural and operational advantages over wire-type coronodes. A significant advantage of the device is reduced production of ozone, which is believed to be proportionally related to nitrogen oxide species production. The sheet metal coronodes have comparatively high structural strength in comparison to wire devices. It is particularly important that coronodes in a reproduction machine be resistant to breakage when subjected to excessive vibration or rough handling, such as occur during coronode cleaning. Such characteristics enhance field maintenance of reproduction devices incorporating breakage resistant coronode structures by reducing potential damage to the photoreceptor due to broken corotron wires, and possible electrical accidents from the dangling high voltage wire. Perhaps most importantly, periods of inoperativeness and the expense of repair are substantially avoided by the use of such structures. Additionally, devices such as dicorotrons require a high voltage alternating current power supply which requires expensive rectifying and transformer circuitry to alter the current to be satisfactory for use. By contrast, pin coronode devices may be driven by direct current voltage source substantially reducing the cost of rectifying and transformer circuitry in the power supply. It is also a feature of the pin array coronode that it produces a highly directionalized corona wind in comparison with wire-type coronodes. By contrast, wire-type coronodes have a significantly less directed corona wind directed radially about the corona producing surface of the wire.

When used to charge a photoreceptor, the pin array coronode finds particularly advantageous use in a scorotron arrangement combining the advantages associated with the use of pin array coronodes with the advantageous aspects of scorotron charging. Photoreceptor deletion problems associated with scorotron charging, however, have been enhanced in part due to the enclosure of the scorotron charging elements with the screen preventing substantial passage of air through the device. Additionally, it is common practice to prevent the flow of air through the scorotron members to prevent contamination thereof from dust or toner particles, which build up along surfaces of the scorotron member thereby changing electric characteristics of the device, causing current leakage from the corona device to the screen, and charging non-uniformities.

SUMMARY OF THE INVENTION

In accordance with the invention, there is provided a scorotron charging device for applying a uniform charge to a photoreceptor surface comprising one or more parallel and spaced pin array coronodes, a conductive screen or grid member disposed between the pin array coronodes and the surface to be charged, a support arrangement for supporting the pin array coronodes and the conductive screen member adjacent to a surface to be charged in relative position, and in operable connection to high and low voltage potentials, respectively. In order to reduce the problem of photoreceptor deletion caused by corona effluents, openings, constituting air passages are formed in the support arrangement to allow the flow of air from the exterior of the scorotron into the area adjacent the coronodes and the screen. Inherent in the operation of the described pin array coronode scorotron, is the generation of a relatively strong, highly directionalized corona wind produced by the strong directional field generated from the pin array coronode to the conductive screen member. The corona wind induces the flow of air from the exterior of the scorotron, circulates air through the area between the pin array coronodes and the conductive screen member, and exhausts the air; and presumably the corona effluents generated by the scorotron through the screen member, where in unconcentrated form the corona effluents are relatively harmless to the photoreceptor.

In accordance with another aspect of the present invention, the support member is comprised of a central support member and first and second complementary side support members provided for supporting each of the pin array coronodes between the central support member and a side member. The support members generally enclose the area adjacent the pin array coronodes with the exception of the area enclosed by the screen member immediately adjacent the surface to be charged. Openings or air holes are provided in at least one of the side support members along the length thereof to allow the free movement of air therethrough and into the areas adjacent to the pin array coronodes and the screen member. Alternatively, a slot opening may be provided along the length of the side support member.

In accordance with another aspect of the present invention, pin array coronodes and a conductive screen interposed between the pin arrays and a surface to be charged are supported in a scorotron housing with a relatively large air circulation path therethrough from the exterior thereof to produce a highly directional corona wind traveling generally in the direction from the corona producing pin array tips to the grid substantially removing corona effluents which may be the cause of photoreceptor deletion on the photoreceptor.

It is therefore a primary object of the invention to provide a scorotron charging arrangement providing a high degree of operability requiring relatively infrequent cleaning, having a potentially long life, and producing a minimum of ozone in the area adjacent a photosensitive surface.

It is another object of the present invention to provide a scorotron arrangement which advantageously reduces the concentration of nitrogenous species associated with photoreceptor deletion problems inherent in corona charging in the area adjacent the coronodes, grid member, and photoreceptor by providing a flow of air therethrough.

It is yet another object of the present invention to provide a scorotron arrangement having a relatively low manufacturing cost, and without providing a mechanical air movement device, and potentially avoiding the need for costly coatings and/or platings on the scorotron.

Figure 2:
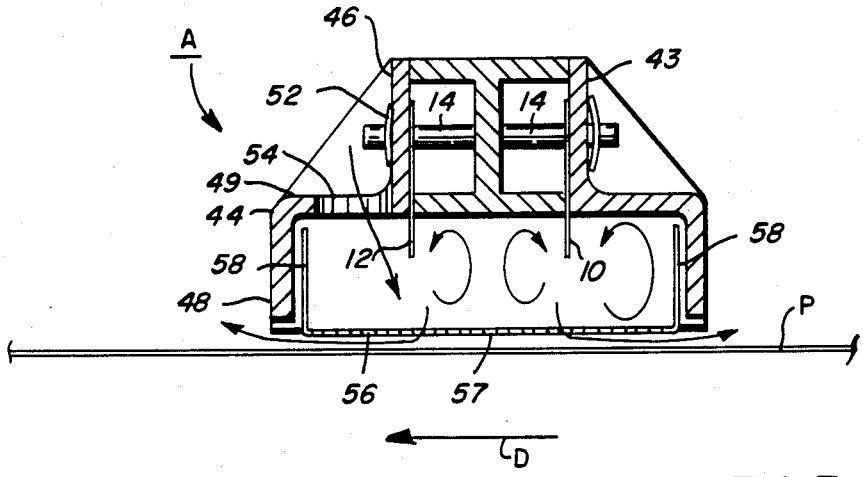
Figure 3:
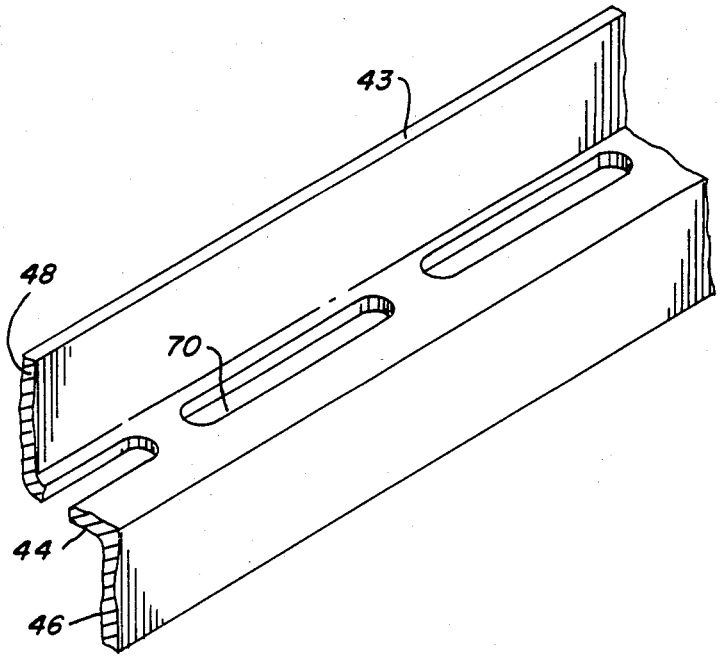

These and other objects and advantages of the invention will become apparent as the following description is reviewed in conjunction with the accompanying drawings in which:

FIG. 1 is a perspective exploded and sectional view of a scorotron in accordance with the invention; and FIG. 2 is a cross-sectional view of the scorotron in accordance with the invention.

Referring now to the drawings, wherein the showings are for the purpose of illustrating a preferred embodiment of the invention and not for the purpose of limiting same, FIGS. 1 and 2 shows a corona generating device comprising a scorotron device. The scorotron device A, as shown in FIG. 1, is characterized by having two pin array coronodes, and a screen disposed between the pin array coronodes and a surface P to be charged, which surface moves in the direction generally indicated by the arrow D. The scorotron pin array coronodes 10 and 12, comprising a pair of elongated sheet metal members having an array of projections or pins 13 extending towards a surface to be charged, are similarly supported on support projections 14 extending outwardly in opposing directions from either side of a central support member 16 at generally corresponding positions and spaced a distance d apart. The distance d is chosen to be as large as possible consistent with the need for a compact device, as smaller d spacings require greater power levels to drive the scorotron. Support projections 14 and locator pin member 18 are provided on central support portion member 16 to correctly position pin array coronode 12 with respect thereto, while another locator pin member (not shown) is located at a slightly offset position on the opposite side of central support member 16 to position the otherwise generally identical pin array coronode 10 in an offset position from pin array coronode 12.

Central support member 16 is provided with a scorotron support portion 20 and mounting block members 22 and 24 on either end thereof. Scorotron support projections 14 extend outwardly from the scorotron support portion 20, from either side thereof, in opposing directions. Projections 14 on either side of the support portion 20 may be located at closely corresponding positions, which allows the advantage of using similar or identical side support members and pin array coronodes. Mounting block 22 supports contact support portions 26 and 28, each respectively supporting high voltage contact member 30 for connection with the pin array coronode and low voltage contact member 32 as well as a locking spring member 34 which engages with a receiving member (not shown) in mounting to a main reproduction machine assembly through locking spring slots 36, 38. Mounting block 24 supports an extension member 40 for insertion into a receiving slot (not shown) in mounting to a main reproduction machine assembly to correctly position the scorotron in a reproduction machine, and locking member 42 which is suitable for engagement with a spring biased locking member on the main reproduction machine assembly.

Scorotron side support members 43 and 44 are generally identical members advantageously provided with a stepped cross section having first and second vertical portions 46 and 48, and a horizontal portion 49 joining them. First vertical portion 46 is provided with support projection receiving openings 50 corresponding to the support projections 14. Pin array coronodes 10 and 12 are supported for operation on support projections 14 between central portion 16 and one of side support members 43 and 44 with the assembly fixed into position with the engagement of fasteners 52 to support projections 14, or hot staking support projections 14 to effect engagement of the support members and pin coronodes.

Screen member 56 is provided in a generally elongated member with a generally U-shaped cross section. The horizontally disposed central portion 57 is comprised generally of a grid pattern having about a 64% open area having parallel side portions 58 extending perpendicularly from central portion 57. Screen member 56 may additionally be provided a coating thereon to further reduce corona induced photoreceptor deletion. Screen member 56 is supported at either end on mounting blocks 22 and 24, and may advantageously be provided with a screw fastener receiving opening 60 disposed at one end which receives fastener member 62 for connection through an opening 64 in mounting block 22 to low voltage potential contact member 32, and spring tongue members 66 which are insertable into receiving openings 68 in mounting block member 24.

To assemble the scorotron, pin array coronode members 10 and 12 are placed in position over support projections 14 and electrically connected, such as by soldering, conductive adhesive, etc., into position with high voltage contact 32. The pin array coronodes are then secured into position on support projections 14 against central support portion 16 with side support members 43 and 44 with fasteners 52 or hot staking the support projections. The scorotron is held in position in the reproduction machine at the mounting block portions disposed to provide the contact support portions available for a plug-type connection to a power source. For the purposes of charging the photoreceptor surface in a reproduction machine, a D.C. voltage of between 6.5–10 kV is applied to the high voltage contact member, while a low D.C. voltage of −500 to −1500 V, or approximately the voltage level desired for the photoreceptor, is applied to the low voltage contact member.

Support members 12, 14 and 16 are advantageously manufactured with a non-conductive, somewhat rigid plastic material, which is injection molded to provide the desired shape. The conductive contact members may be easily molded into the support members simultaneously with their manufacture. In a preferred embodiment, the plastic is 20% glass filled to provide a degree of desired rigidity.

In accordance with the invention, one or both of scorotron side supports 43 and 44 may advantageously be provided with an opening or array of openings 54 along horizontal portion 49. Openings 54 in horizontal portion 49 of side support members 43 and 44 serve to allow the flow of air into the scorotron device to the area adjacent the surface to be charged. Corona winds generated by the pin arrays and directed towards the central portion 57 of screen 56, and thus the surface to be charged, creating a vacuum at openings 54 which draw clean air into the scorotron structure. By clean air, it is meant that the drawn-in air does not have the relatively high concentration of corona byproducts that the air within the scorotron possesses. If the air does have a high level of toner or dust particles, which may contaminate the scorotron, air filters (not shown) having a minimum resistance to airflow may be provided covering either or both of the openings. Alternatively, as shown in FIG. 1, only a single side of the scorotron directed away from areas having high toner dust concentrations, such as the downstream side of the scorotron, may be provided with airflow openings 54. In a preferred embodiment, openings 54 are generally about 80–100 $mm^2$, and may comprise almost any shape, although sharp corners are to be avoided because such shapes encourage arcing, and in the present embodiment, are generally rectangularly shaped, having an arc shaped perimeter at one end thereof. For a scorotron having openings of the described dimensions, there may be about 30 openings giving an open airflow area of about 2400 to 3000 $mm^2$. The dimensions may vary based on the desired size of the openings which must not be so large as to weaken the structural integrity of the device. As an alternative, one or two elongated slotted openings may be provided. Such elongated slot openings also serve to advantageously prevent the build-up of chemical salt byproducts of corona emissions, which tend to cause leakage of current from the pin array coronodes to the screen. It will additionally be appreciated that airflow openings may be provided in scorotron support portion 20, extending from the exterior of the device to the area about the pin array coronodes, screen and photoreceptor.

Referring to FIG. 2, examination of the airflow relative to a photoreceptor surface through the structure of the scorotron is a helium bubble demonstrated that separate areas of airflow occur within the scorotron structure as indicated by the arrows indicated therein. In the areas immediately adjacent to the pin array coronodes 10 and 12, there is a movement of air parallel to the coronodes towards central portion 57 of screen 56. As the air current impinges on screen 56, a portion thereof is forced through the grid portion of the screen while another portion is directed upwardly towards the side and central support members of the scorotron causing a rapidly circulating air current in the regions between through the pin coronodes 10 and 12 and the upright screen side portions 58, and between the pin coronodes. Air current returning to the vicinity of the pin coronodes is again downwardly directed towards the screen. The turbulence of the air, and its removal at relatively high volumes have the effect of preventing adsorption of the corona effluents into the conductive materials of the scorotron. Additionally, relative movement of the scorotron and the photoreceptor surface P aids in the removal of the air laden with corona effluents from the scorotron interior.

In a device with the described characteristics, an estimated airflow of 95 liters/min., produced without the aid of mechanical airfow systems, is derived by the strong directional field providing a voltage difference of 9 kV over a spacing of 9 mm. between the pin array and the screen. In conjunction with an estimated ozone production of 600 μgm/min.; an ozone concentration of only 6 μgm/liter were noted. By contrast, without air holes or openings, the figure was noted to be about 25 μgm/liter. Similar tests with a comparable dicorotron device with a mechanical airflow system showed an ozone product of 2200 μgm/min., and with an air flow of 71 liters/min., deriving an ozone concentration of 33 μgm/liter. Accordingly, the combination of the air holes or openings in use with the pin array coronodes produce an improvement in the concentration of corona effluents by a factor of about 4 times without the need for costly airflow systems. The increased quantity of airflow directed against the photoreceptor has resulted in dislodgment of toner from the photoreceptor surface making the toner particles airborne within the system. Providing the airflow openings on only a single side of the scorotron, on the side facing downstream from the process direction, has successfully remedied the problem of toner being drawn into the scorotron and contaminating the structure.

The invention has been described with reference to a particular embodiment. Modifications and alterations will occur to others upon reading and understanding this specification. It is intended that all such modifications and alterations are included insofar as they come within the scope of the appended claims or equivalents thereof.

What is claimed is:

1. A scorotron assembly for charging a photoconductive surface to a uniform potential comprising:

corona generating means including at least a first pin array coronode having an array of projections formed integrally thereon and extending therefrom towards a photoconductive surface to be charged, said corona generating means operatively connected to a relatively large negative voltage potential for the production of ions directed towards said surface;

a conductive screen member operatively connected to a voltage potential approximately equal to the desired potential on said surface to be charged whereby a directional flow of ions is generated from said corona generating means towards and through said conductive screen member, creating a substantially parallel air flow flowing therewith;

support means supporting said screen member and said corona member, with said screen member between said corona generating means and said surface to be charged;

means defining an opening in said support member to allow the flow of air therethrough into an area between said screen member and said support means.

2. The scorotron as defined in claim 1 wherein said means defining an opening in said support means is comprised of a plurality of discrete openings arranged along a length of said support means, said openings forming an air passage extending from exterior of said support means to the area between said area between said screen member and said support means.

3. The scorotron as defined in claim 1 wherein said means defining an opening in said support means is comprised of a slot opening arranged along a length of said support means, said slot opening forming an air passage extending from exterior of said support means to the area between said screen member and said support means.

4. The scorotron as defined in claim 1 wherein said support means is comprised of a central support member and complementary first and second side support members supporting said at least first pin array coronode between one of said first and second side support members and said central support member and said means defining an opening in said support means is supported on at least one of said side support members.

5. The scorotron as defined in claim 4 wherein said surface to be charged moves in a process direction relative to said corona generating means, and said means defining an opening in said support member is supported on the downstream side of the support member.

6. A scorotron charging assembly for charging a photoconductive surface to a uniform potential comprising:

corona generating means including a pair of pin array coronodes having an array of projections formed integrally thereon, extending therefrom, and directed to a photoconductive surface to be charged, said corona generating means operably connected to a relatively high negative voltage potential for the production of ions directed towards said surface;

a central support member for supporting the pin array coronodes in parallel spaced arrangement;

at least first and second side support members engaging with said central support member, whereby each pin array coronode is supported between the central support member and a side support member;

a conductive screen member supported on the central support member between the pin array member and the surface to be charged, and operably connected to a voltage potential approximately equal to the potential desired on said surface to be charged;

said screen member and said corona generating means effecting a directional flow of corona discharge from said corona generating means towards said surface to be charged, said directional flow of corona inducing a parallel air current flow; and means defining an air entrance in at least one of said first and second side support members, whereby said air current flow draws air therethrough into an area defined by said screen member and said support members and exhausting said air through said screen to remove corona effluents from said area.

* * * * *